United States Patent [19]

Miles

[11] 4,257,759

[45] Mar. 24, 1981

[54] FUEL BURNER PRIMARY CONTROL MEANS

[75] Inventor: Gregory M. Miles, Minneapolis, Minn.

[73] Assignee: Honeywell Inc., Minneapolis, Minn.

[21] Appl. No.: 20,698

[22] Filed: Mar. 15, 1979

[51] Int. Cl.[3] ..... F23N 5/00

[52] U.S. Cl. ..... 431/31; 431/78

[58] Field of Search ..... 431/29–31, 431/78, 51

[56] References Cited

U.S. PATENT DOCUMENTS

| | | | |
|---|---|---|---|
| 3,335,781 | 8/1967 | Krump | 431/29 |
| 3,514,240 | 5/1970 | Potts . | |
| 3,574,495 | 4/1971 | Landis | 431/31 |
| 3,715,180 | 2/1973 | Cordell | 431/31 |
| 4,113,419 | 9/1979 | Cade | 431/31 |
| 4,137,038 | 1/1979 | [illegible] | 431/78 |

FOREIGN PATENT DOCUMENTS

| | | | |
|---|---|---|---|
| 2806700 | 8/1978 | Fed. Rep. of Germany | 431/31 |

*Primary Examiner*—Joseph Man-Fu Moy

*Attorney, Agent, or Firm*—Alfred N. Feldman

[57] ABSTRACT

A fuel burner primary control with a pre-purge and extended ignition function has been disclosed. The system has been disclosed as an oil burner which utilizes a voltage regulator to insure that adequate power is supplied to the device and with a time delay on the application of potential to the ignition and oil source to allow for a pre-purge interval. The ignition source is also time delayed to insure a stable flame before the ignition is deenergized.

12 Claims, 1 Drawing Figure

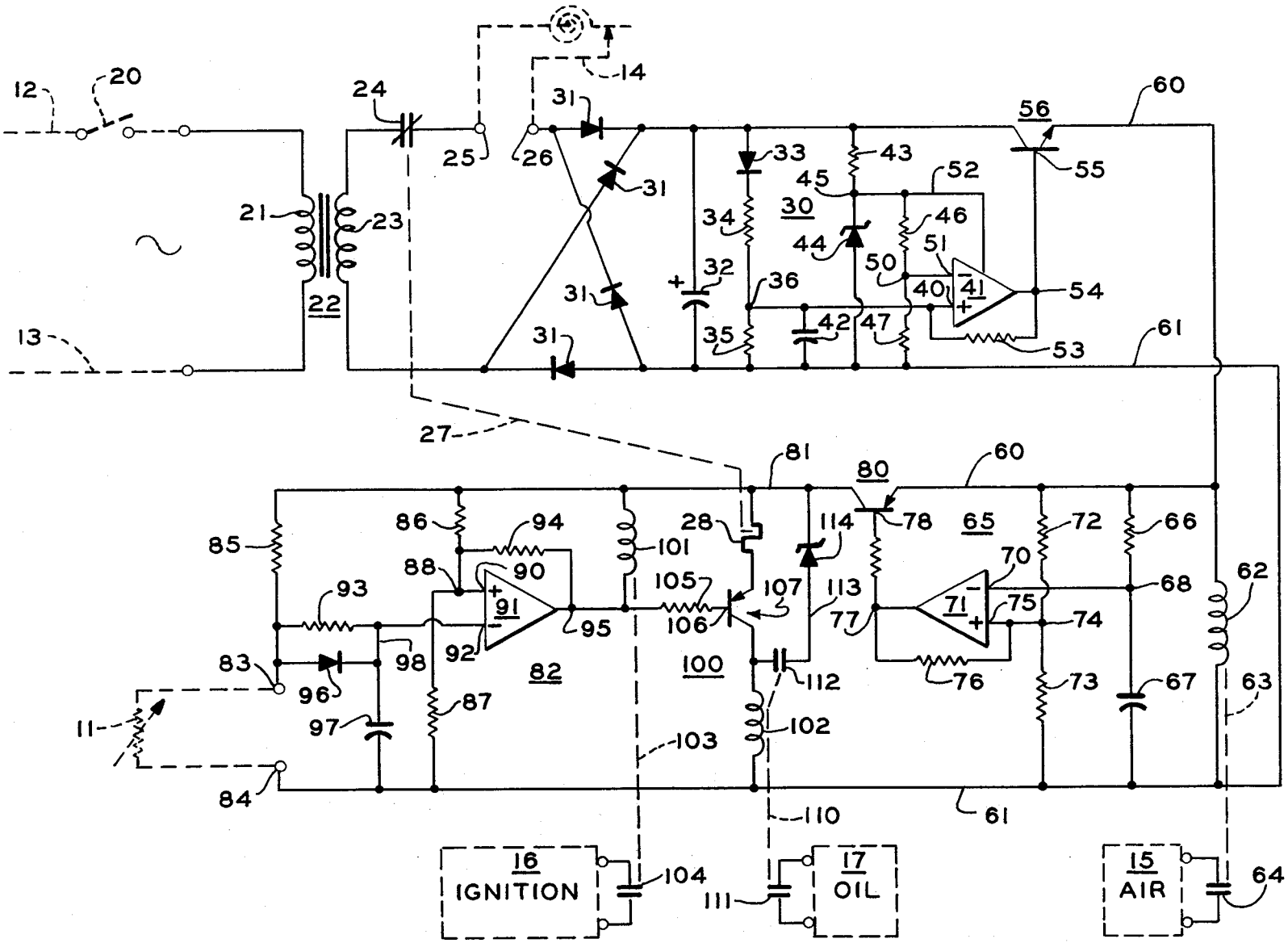
15
AIR
17
OIL
16
IGNITION

FUEL BURNER PRIMARY CONTROL MEANS

BACKGROUND OF THE INVENTION

In recent years the method or mode of operating fuel burners has been altered because of the escalating cost of fuel. Until recent years, fuel burners, particularly oil burners, were operated with an intermittent source of ignition, a source of combustion air, and the continuous monitoring of a flame by a sensor. The sensor normally was a cadmium sulfide type of cell. The control devices themselves generally were large and utilized electromechanical components.

In order to accommodate for the higher operating costs, fuel burners of the oil burner type are now more commonly operated with an interrupted source of ignition. The quality of the fuel being used now varies considerably, as opposed to a more uniform quality of fuel that was available a number of years ago. This variation in fuel quality and the intermittent operation of an ignition source provides a potential for the loss of flame which is less stable under present operating conditions than under the older operating conditions. Also, the power available to the control devices from the normal line sources has more of a tendency to vary now than the better regulated potentials that were available in the past.

The poor regulation, the variance in fuel, the intermittent ignition, and other related problems tends to create a fuel burner or oil burner environment which is less stable than desirable.

SUMMARY OF THE INVENTION

The present invention is directed to a generally solid state oil primary control with a pre-purge and extended ignition function. The present device utilizes the energy available from a conventional alternating current line source after it has been rectified and regulated by a voltage regulating means. The voltage regulating means is capable of providing not only a voltage that is regulated for the balance of the system, but is capable of removing all of the potential from the device so that the burner is shut down in a safe fashion if a low voltage is inadvertently applied.

The present invention also supplies a slight time delay in the start up of the unit so that a pre-purge air flow is provided and the air flow becomes stable before an attempt is made to ignite the fuel. Once the fuel is ignited, a further time delay is provided before the ignition source is removed so that the flame, which is monitored by a flame sensor, becomes stable before the ignition means is deenergized.

The present device provides three desired functions in an integrated unit. The functions mentioned above are the regulation of the voltage, the time necessary to establish a pre-purge and stabilized air flow, and the extended ignition to allow for stabilized flame before the ignition source is removed. All of these functions are accomplished with a minimum of electronic circuitry that is compact and has a low level of energy consumption. While the device specifically disclosed utilizes electromagnetic relays as the final output elements, these relays could readily be replaced by solid state switching, if desired.

BRIEF DESCRIPTION OF THE DRAWING

The single FIGURE discloses a schematic circuit of a burner control means.

DESCRIPTION OF THE PREFERRED EMBODIMENT

A fuel burner primary control 10 is disclosed and is adapted to be connected to a fuel burner. The fuel burner will be disclosed as including the elements of a typical oil burner. These elements include a flame sensor means 11 which is normally a cadmium sulfide cell, and alternating current source between conductors 12 and 13, a condition responsive means or thermostat 14, a source of air 15, a source of ignition 16, and a source of oil 17. In the operation of a present day oil burner, it is understood that upon a call for operation by the closing of thermostat 14, the air source 15 is put into operation. A source of ignition 16 is initiated along with a flow of oil 17. As soon as flame is sensed in the oil burner, the sensor means 11 responds by changing from a relatively high resistance value in the dark ambient to a relatively low resistance value in the presence of a flame. To this point, a conventional fuel burner or oil burner has been generally described. The unique fuel burner primary control will now be detailed.

Power from the conductors 12 and 13 is fed through a switch 20 to a primary winding 21 of a transformer 22 that supplies a step down secondary voltage at 23. Step down voltage is normally in the range of 24 volts so that the device can be operated at a low voltage level for convenience and safety. The transformer secondary 23 is connected to a safety switch contact 24 to a terminal 25 that is used to connect to a condition control means or thermostat 14. A terminal 26 is provided for the return of the conductor to the thermostat 14. The normally closed safety switch 24 is connected at 27 to a bimetal member and heater 28. The heater 28 is connected in a further portion of the circuit that will be described subsequently.

The transformer secondary 23, the safety switch contact 24, and the thermostat 14 connect power to a voltage regulator means generally disclosed at 30. The voltage regulator means 30 includes four diodes 31 that are connected in a full wave bridge configuration that is across the input power and supplies a direct current to a capacitor 32. The capacitor 32 further supplies power to a voltage divider network made up of a diode 33 and two resistors 34 and 35. The voltage between the resistors 34 and 35 (at the junction 36) is connected to the noninverting terminal 40 of an operational amplifier 41. A capacitor 42 is connected across the resistor 35 to statilize the voltage on the noninverting terminal 40.

A further voltage divider network made up of a resistor 43 and a zener diode 44 are connected across the potential of capacitor 32 and act as a reference voltage at a junction 45. The reference voltage at 45 is connected to a further resistor 46 and to a resistor 47 with a common 50 connected to an inverting terminal 51 of the operational amplifier 41. A further connection 52 is provided between the junction 45 and the operational amplifier 41. A feedback resistor 53 is provided from an output 54 of the operational amplifier 41 and the noninverting terminal 40. The output junction 54 is connected to the base 55 of a transistor 56 that has its collector-emitter circuit connected in series with a conductor 60. The conductor 60 along with a further conductor 61 (which is a common conductor for the entire control device) provides a pair of conductors for a regulated direct current output voltage. The full wave bridge made up of the diodes 31, the voltage dividers at the input of the operational amplifier 41, the operational amplifier 41 along with the transistor 56 provide a well regulated direct current potential source to the conductors 60 and 61. This voltage regulator is designed so that if the input voltage on the conductors 12 and 13 drops below a predetermined value, there is no output on the conductors 60 and 61 thereby deenergizing the balance of the fuel burner primary control means. When a voltage is available, is is well regulated at a selected voltage level.

The voltage across conductors 60 and 61 appears directly across a first switch means 62 which has been disclosed as a solenoid of a relay. The solenoid 62 is mechanically connected at 63 to a contact 64 that energizes the source of air 15. The relay or switch means 62, 63 and 64 could be a solid state switch but is disclosed as a conventional relay.

As soon as a potential appears at the conductors 60 and 61, it is immediately applied to a time delay switch means disclosed at 65. The time delay switch means 65 is made up of a voltage divider having a resistor 66 and a capacitor 67 connected across the conductors 60 and 61. A junction 68 between the resistor 66 and the capacitor 67 is connected to the inverting terminal 70 of an operational amplifier disclosed at 71. A second voltage divider network made up of resistors 72 and 73 is provided with a junction 74 that is connected to the noninverting terminal 75 of the operational amplifier 71. A feedback resistor 76 is provided from an output 77 of the operational amplifier 71 to the noninverting terminal 75. The output 77 is connected to a base 78 of a transistor 80 which is connected with its emitter and collector in series with the conductor 60.

The time delay switch means 65 includes the pair of voltage divider means in the input of the operational amplifiers 71, as well as, the transistor output switch 80. As soon as a potential is supplied to the conductor 60 and 61, the capacitor 67 beings to charge. During the charge period, the transistor 80 is in a nonconductive state. As soon as the capacitor 67 charges to a sufficient point, the transistor 80 becomes conductive and the potential which is available on conductor 60 now becomes available on a conductor 81. The voltage appearing between the conductors 81 and 61 is then available for the balance of the system which is a flame responsive circuit means generally disclosed at 82.

The flame responsive circuit means 82 includes the sensor means 11 connected to a pair of terminals 83 and 84. The terminal 84 is directly connected to the conductor 61 while the terminal 83 is connected through a resistor 85 to the conductor 81. The potential across the conductors 81 and 61 is also connected through a voltage divider network made up of resistors 86 and 87 with the common junction 88 connected to the noninverting terminal 90 of an operational amplifier 91. The inverting terminal 92 of the operational amplifier 91 is connected through a resistor 93 to the terminal 83. A feedback resistor 94 is provided from an output 95 of the operational amplifier 91 to the noninverting terminal 90.

The output 95 of the operational amplifier 91 switches in response to the presence of absence of flame at the sensor means 11. In the present invention a time delay circuit is incorporated in the input circuit to the operational amplifier 91. The time delay circuit includes a diode 96 and a capacitor 97 which have a common junction 98 connected to the inverting terminal 92 of the operational amplifier 91. The function of this time delay circuit will be described later in the description of operation of the overall device.

The output of the operational amplifier 91 is at 95 and it in turn controls an output circuit means generally disclosed at 100. The output circuit means 100 includes two switch means. The first is switch means 101 while the second switch means is disclosed at 102. The first switch means 101 is disclosed as a relay coil having a mechanical connection 103 to a contact 104 that energizes the ignition 16. The relay coil 101 is connected at 95 to a resistor 105 that is connected to the base 106 of a transistor 107. The transistor 107 has the heater resistor 28 of the safety switch means connected between the emitter of the transistor and the conductor 81. The collector of the transistor 107 is connected to the relay coil 102 to the conductor 61. The relay 102 has a connection 110 to a contact 111 that is connected to the source of oil 17. The relay 102 has a further contact 112 that is connected by conductor 113 to a zener diode 114 that in turn is connected back to the conductor 81. The relay 102, when it is operated, latches itself in through the contact 112 and the zener diode 114 across the potential available on the conductors 81 and 61.

OPERATION

Upon the closing of switch 12 and a call for heat by the closing of the thermostat 14, a potential is connected to the rectifier bridge made up of the diodes 31. At this time energy is supplied to the capacitor 32 where a direct current potential is then developed between the conductors of the voltage regulator means 30. The voltage is then supplied to the operational amplifier 41 which acts to control the transistor 56 to supply a highly regulated voltage between the conductors 60 and 61. The voltage regulator means 30 that is disclosed is a well known type of regulator in which a reference voltage at zener 44 and the voltage at the junction 36 is compared by the operational amplifier 41 to control the conduction of the transistor 56. It is not believed that a further detailed explanation of the voltage regulator is necessary. The only thing that is important at this point is that a regulated voltage appears between the conductors 60 and 61 whenever the applied voltage between the conductors 12 and 13 is of a sufficient magnitude. If the input voltage drops below a preset design level, there is no voltage appearing between the conductors 60 and 61 and the balance of the system is therefore turned "off" in a safe manner.

The regulated voltage between the conductors 60 and 61 is immediately supplied to the switch means or relay 62 and closes the switch 64 which supplies air from the air source 15. The voltage between conductors 60 and 61 is then also supplied to the time delay means 65. While the time delay means 65 is building up a voltage on the capacitor 67, the air source is purging the burner of any undesirable unburned components. As soon as the voltage on capacitor 67 reaches a pre-established level designed into the system by the selection of components of the resistors 66, 72, 73, 76 and the capacitor 67, the operational amplifier 71 switches the transistor 80 from an "off" state to an "on" state.

As soon as the time delay interval has expired, the voltage on conductors 60 becomes available on conductor 81. As soon as the voltage becomes available on conductor 81 the voltage between the conductors 81 and 61 is applied to the flame responsive means 82, where the cadmium sulfide cell 11 is exposed to the burner itself. If the burner is dark, the resistance of the cell 11 is relatively high and relatively high voltage is thereby applied to the inverting terminal 92 of the operational amplifier 91. This causes the output 95 of the operational amplifier 91 to switch to a low voltage. The low voltage at 95 causes two different functions to occur. The first function is that the relay 101 pulls in and activates switch 104 to turn "on" the ignition 16. At this same time the voltage at 95 is connected through the resistor 105 to the base 106 of the transistor 107. By pulling the base 106 of transistor 107 to the relatively low voltage at the junction 95, the transistor 107 begins to conduct. The condition immediately starts heating the heater 28 and causes current to flow through the relay coil 102. As soon as the relay 102 starts drawing current, the contact 111 closes to add oil to the burner and simultaneously the contact 112 closes through the zener diode 114 to latch the relay 102 into an energized state.

At this point all three relays 62, 101 and 102 are energized as is the safety switch heater 28. At this same time air is being supplied by 15, ignition is being supplied by the ignition source 16 and oil is being supplied by the oil source 17. In a properly operating burner the oil will ignite and the sensor 11 will switch from a high value to a relatively low value of resistance.

Prior art devices would cause the system to immediately respond. In the present system the switching from a relatively dark or high value of the sensor to a relatively low value across the terminals 83 and 84 is delayed in effect by the discharge of the charge that was stored on the capacitor 97 while the system was waiting for the ignition of oil. The voltage on capacitor 97 decays by discharging through the resistor 93 and the sensor 11 so that the voltage on the inverting terminal 92 is held at a value to keep the output of the operational amplifier 91 low at 95 for a short time delay while the flame is stabilizing.

As soon as the flame has had an opportunity to stabilize by the discharge of the capacitor 97 through the resistor 93 and the sensor 11, the operational amplifier 91 will switch its output 95 to a high voltage at or near the voltage on conductor 81. This immediately drops out the relay 101 thereby turning "off" the ignitions 16. When the voltage at 95 goes high and drops out the relay 101, it also raises the voltage on the base 106 of the transistor 107, and the transistor 107 ceases to conduct. This ends the heating of the safety switch heater 28. The relay 102 remains in the circuit since it has latched itself in through the contact 112.

The above description of operation is a normal sequence of events in which a time delay is provided for a pre-purge, along with a time delay for stabilization of the flame. The entire system is monitored continuously for an appropriate voltage level by the voltage regulator means 30 so that the system not only gets to an operating level in a safe manner, but it is continuously monitored against the line voltage to insure that the system remains in a stable and safe state. If the line voltage should drop for any reason, the entire system will drop out and the burner will be caused to recycle in a normal and safe manner.

The system described to this point is a highly simplified system utilizing a minimum of solid state components and three control relays. The control relays could be readily replaced by solid state switching to make an entire unit solid state. Other modifications in the types of time delays and voltage regulation could be applied. As a result, the applicant wishes to be limited in the scope of his invention solely by the scope of the appended claims.

The embodiments of the invention in which an exclusive property or right is claimed are defined as follows:

1. A fuel burner primary control adapted to respond to a condition responsive means to operate fuel burner means which includes an air source, a fuel source, an ignition means, and sensor means responsive to a flame in said burner means, including: switching voltage regulator means having a switched output connected to a power source upon operation of said condition responsive means to provide a regulated direct current output voltage when said power source is above a predetermined level; said predetermined level being selected to insure proper operation of said fuel burner primary control; said regulated output voltage providing an operating potential for said primary control and simultaneously energizing air control switch means to provide said air source to said burner means; electronic time delay switch means energized by said output voltage to provide a time delay between the application of said output voltage to said time delay switch means and the availability of said output voltage to further circuit means; flame responsive circuit means including said sensor means connected and arranged to control amplifier means; said amplifier means having output circuit means including second and third switch means; said second switch means controlled by said amplifier means to energize said second switch means from said further circuit means whenever said sensor means fails to detect a flame to thereby energize said ignition means; third switch means energized initially with said second switch means to supply said fuel source to said burner means; said third switch means including a normally open circuit which closes upon operation to latch said third switch means into an energized state from the potential from said further circuit means; and safety switch means energized concurrently with said second switch means; said safety switch means including switch contact means connected and arranged to deenergize said primary control upon the failure of a flame being sensed by said sensor means in a predetermined safe time interval.

2. A fuel burner primary control as described in claim 1 wherein said second and said third switch means are relay means.

3. A fuel burner primary control as described in claim 2 wherein said voltage regulator means includes rectifier means with an output circuit connected to voltage reference means; and solid state switch means controlled by a voltage from said voltage reference means to provide said regulated output voltage.

4. A fuel burner primary control as described in claim 2 wherein said time delay switch means includes a series circuit including resistor means and a capacitor; and solid state switch means controlled by a voltage from said series circuit to operate said time delay switch means to apply said regulated output voltage to said further circuit means.

5. A fuel burner primary control as described in claim 4 wherein said flame responsive circuit means includes said sensor means and voltage divider resistor means in series to operate flame responsive amplifier means in response to the presence or absence of flame.

6. A fuel burner primary control as described in claim 5 wherein said flame responsive circuit means further includes voltage storage means to establish a time delay in the operation of said flame responsive amplifier means; said voltage storage means controlling said flame responsive means to keep said second relay means energized for a short time after flame is sensed by said flame sensor means to extend the operation of said ignition means to stabilize the flame in said burner means before said ignition means is deenergized.

7. A fuel burner primary control as described in claim 6 wherein said voltage storage means includes a parallel combination of a resistor and a diode with said parallel combination connected in a series circuit with a capacitor.

8. A fuel burner primary control as described in claim 6 wherein said safety switch means is a heater and bimetal controlled latched switch.

9. A fuel burner primary control as described in claim 8 wherein said rectifier means includes four diodes in a full wave bridge.

10. A fuel burner primary control as described in claim 2 wherein said voltage regulator means, said time delay switch means, and said flame responsive circuit means include an output transistor as a controlled element.

11. A fuel burner primary control as described in claim 1 wherein said flame responsive circuit means further includes voltage storage means to establish a time delay in the operation of said flame responsive amplifier means; said voltage storage means controlling said flame responsive amplifier means to keep said second switch means energized for a short time after flame is sensed by said flame sensor means to extend the operation of said ignition means to stabilize the flame in said burner means before said ignition means is deenergized.

12. A fuel burner primary control as described in claim 11 wherein said voltage storage means includes a parallel combination of a resistor and a diode connected in a series circuit with a capacitor.

* * * * *